US006487798B2

(12) United States Patent
Sueshige

(10) Patent No.: US 6,487,798 B2
(45) Date of Patent: Dec. 3, 2002

(54) CHUTE STRUCTURE FOR SNOW REMOVING MACHINE

(75) Inventor: Hiroshi Sueshige, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/903,595

(22) Filed: Jul. 12, 2001

(65) Prior Publication Data

US 2002/0007573 A1 Jan. 24, 2002

(30) Foreign Application Priority Data

Jul. 21, 2000 (JP) ..... 2000-220794

(51) Int. Cl.[7] ..... E01H 5/09
(52) U.S. Cl. ..... 37/260; 16/250
(58) Field of Search ..... 37/244, 248, 249, 37/253, 254, 260, 261, 262; 16/221, 277, 308, 250, 251, 232

(56) References Cited

U.S. PATENT DOCUMENTS

| | | | | |
|---|---|---|---|---|
| 251,591 | A | * | 12/1881 | Jaeger |
| 392,628 | A | * | 11/1888 | Moran |
| 1,037,394 | A | * | 9/1912 | Wood |
| 1,234,887 | A | * | 7/1917 | Emory |
| 2,200,623 | A | * | 5/1940 | James |
| 2,750,235 | A | * | 6/1956 | Frushour |
| 3,075,813 | A | * | 1/1963 | Vohl |
| 3,397,422 | A | * | 8/1968 | Youngdale |
| 4,651,452 | A | * | 3/1987 | Husso |
| 4,932,101 | A | * | 6/1990 | Lualdi |
| 5,490,306 | A | * | 2/1996 | Floyd et al. |
| 5,533,234 | A | * | 7/1996 | Bizek |
| 5,575,037 | A | * | 11/1996 | Tolle et al. |
| 5,791,017 | A | * | 8/1998 | Kluting |
| 6,041,478 | A | * | 3/2000 | Martin |

FOREIGN PATENT DOCUMENTS

| | | |
|---|---|---|
| JP | 63076025 | 5/1988 |
| JP | 02089014 | 7/1990 |

* cited by examiner

*Primary Examiner*—Victor Batson
(74) *Attorney, Agent, or Firm*—Adams & Wilks

(57) ABSTRACT

A chute structure for a snow removing machine includes first and second chutes connected through a hinge to each other. The hinge includes first and second hinge plates connected together by means of a connecting pin. The first hinge plate has a tubular portion through which the connecting pin extends. The length of the tubular portion is substantially equal to the width of the first chute. The second hinge plate has first and second plates. The first plate has an opening formed therein. The opening of the first plate is aligned with an entrance of the tubular portion. The second plate has an opening formed therein. The opening of the second plate is aligned with an exit of the tubular portion. The second hinge plate has a cover portion extending between the first plate and the second plate. The cover portion is integral with the first and second plates. The cover portion covers the tubular portion. Provision of the cover portion prevents snow from being discharged from around the hinge.

2 Claims, 13 Drawing Sheets

CHUTE STRUCTURE FOR SNOW REMOVING MACHINE

BACKGROUND OF THE INVENTION

1. Field of the Invention

The present invention relates generally to a snow removing machine including a chute and a blower for blowing snow into the chute, and in particularly to the chute structured or designed to throw such snow towards a desired point.

2. Description of the Related Art

Known snow removing machines include auger members for collecting snow piled up on roads, and blowers for blowing the collected snow into chutes connected to the blowers. The chutes throw such snow towards desired points. The chutes are rotatable or bendable to throw the snow by selected distances or in selected directions. One example of such chutes is known from Japanese Utility Model Laid-Open Publication No. 63-76025 entitled "HINGED STRUCTURE OF CHUTE FOR SNOW REMOVING MACHINE". The disclosed snow removing machine comprises a chute. FIG. 13 hereof shows such a chute 100. The chute 100 includes a chute body 107*a* and a chute guide 107*b* attached via a hinge member 109 to the chute body 107*a*. The hinge member 109 includes first and second halves 109*a*, 109*b* connected together. The chute guide 107*b* has an arcuate portion 110 configured to close gaps (not shown) formed between the first and second halves 109*a*, 109*b*. Provision of the arcuate portion 110 prevents snow from coming out of these gaps.

However, the chute 100 faces one problem that clearances 104, 104 are necessarily formed between the first and second halves 109*a*, 109*b*. Some of snow to be directed out of the chute guide 107*b* would be undesirably discharged from these clearances 104, 104. There is a need in the art for an improved chute structure which provides for the prevention of such an undesirable discharge of the snow.

SUMMARY OF THE INVENTION

An object of the present invention is to provide an improved chute structure including chutes connected together via hinges designed to prevent snow from being discharged from between the chutes.

According to an aspect of the present invention, there is provided a chute structure for a snow removing machine, comprising: a first chute; and a second chute pivotally connected via a hinge to the first chute; the hinge including: a first hinge plate mounted to the first chute and having a tubular portion of length substantially equal to a width of the first chute; a second hinge plate mounted to the second chute, the second hinge plate including a first plate being positioned outside one end of the tubular portion and having formed therein an opening aligned with the one end of the tubular portion, a second plate being positioned outside another end of the tubular portion and having formed therein an opening aligned with the another end of the tubular portion, and a cover portion extending between the first plate and the second plate and covering the tubular portion; and a connecting pin extending through the opening of the first plate, the tubular portion, and the opening of the second plate to connect the first hinge plate and the second hinge plate together.

By providing the seamless single tubular portion having the length substantially equal to the width of the first chute, little or no snow is discharged out through the tubular portion.

The first plate has the opening aligned with the entrance of the tubular portion while the second plate has the opening aligned with the exit of the tubular portion. The cover portion covers the tubular portion. The cover portion is continuous with the first and second plates. This arrangement prevents snow within the chute structure from being discharged from around the tubular portion.

Preferably, the connecting pin is substantially rectangular, and includes: a body extending through the opening of the first plate, the tubular portion, and the opening of the second plate; a first U-shaped portion continuous with one end of the body; a return portion continuous with the first U-shaped portion and having substantially the same length as the body; and a second U-shaped portion continuous with the return portion and having a distal end laid on the body, the distal end having a surface abutted on the second plate.

BRIEF DESCRIPTION OF THE DRAWINGS

A preferred embodiment of the present invention will hereinafter be described in detail, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
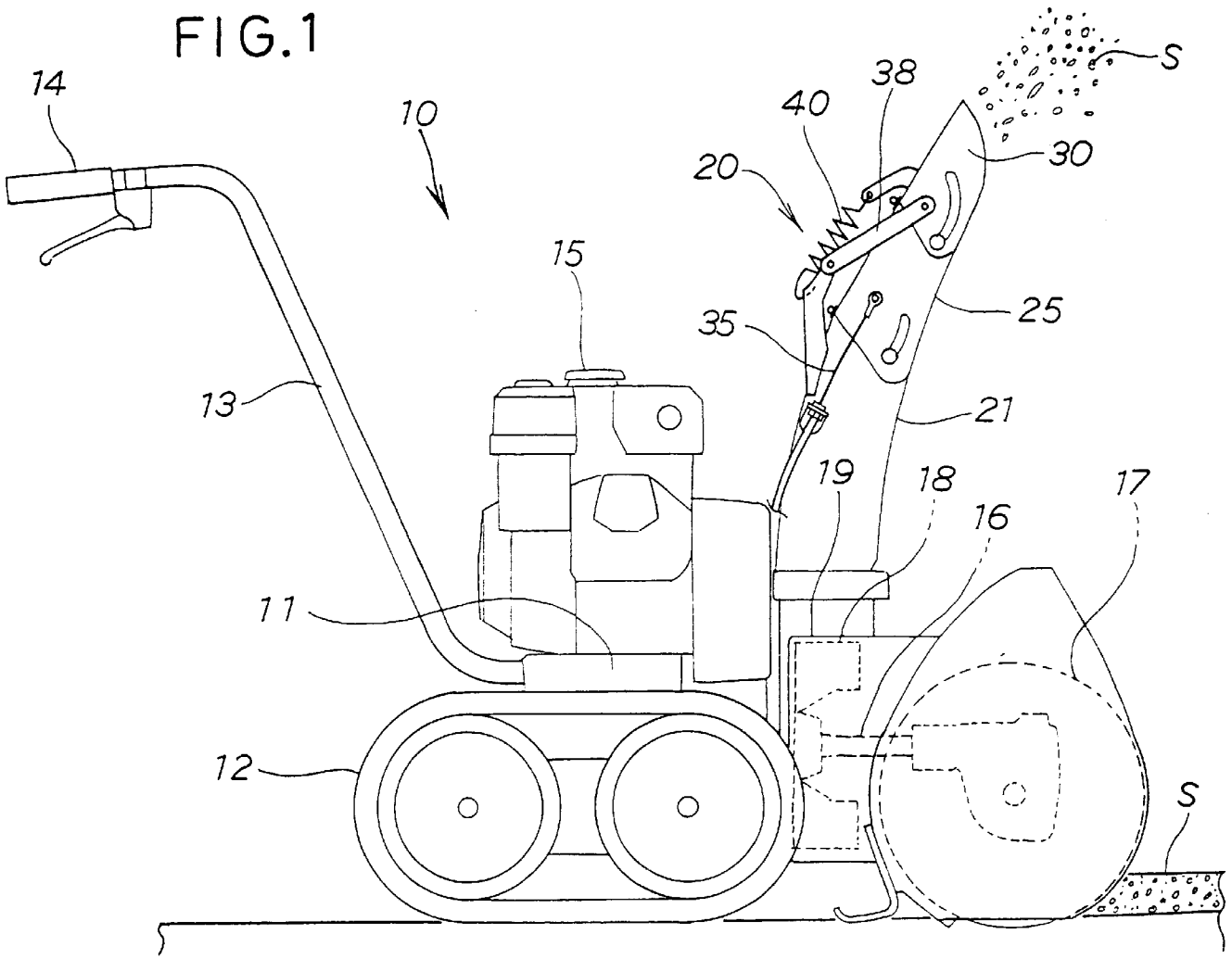
FIG. 1 is a side elevation view of a snow removing machine employing a chute structure according to the present invention.

Referring initially to FIG. 1, a snow removing machine 10 comprises a vehicle frame 11. The vehicle frame 11 has wheels 12 with endless belts (only one shown) attached thereto. The vehicle frame 11 also has a handle post 13 mounted to a rear end thereof. The handle post 13 has a handle 14 attached thereto. An engine 15 is mounted on the vehicle frame 11. The engine 15 is arranged to drive a drive shaft 16. Connected to an end of the drive shaft 16 is an auger 17 for scraping and collecting snow S. Behind the auger 17, there is disposed a blower 18 for blowing the collected snow into a chute structure 20. The chute structure 20 is rotatably mounted on a case 19 which houses therein the auger 17 and the blower 18. The chute structure 20 discharges the snow S into the air.

Figure 2:
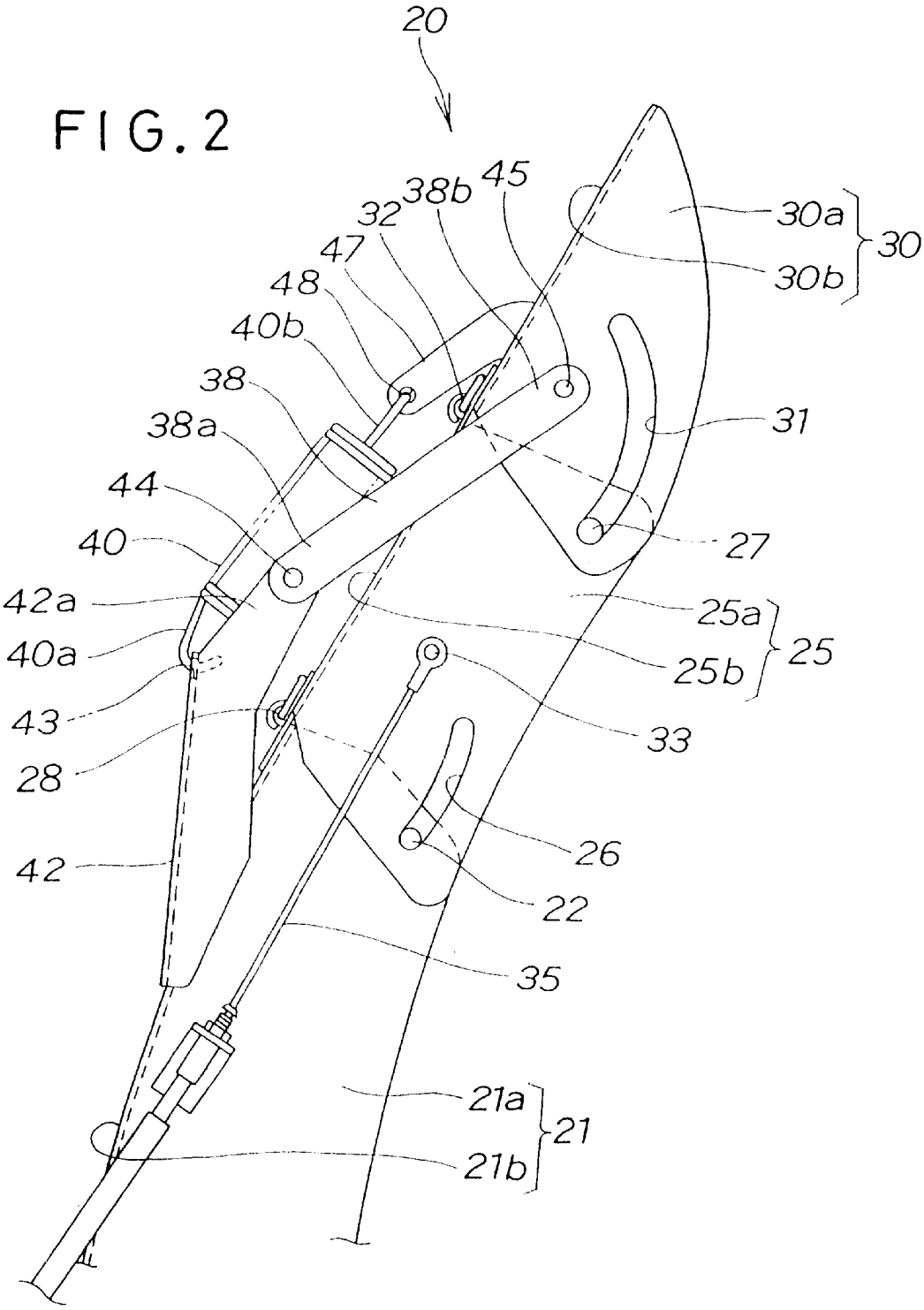
FIG. 2 is a side elevation view of the chute structure of FIG. 1.
Figure 3:
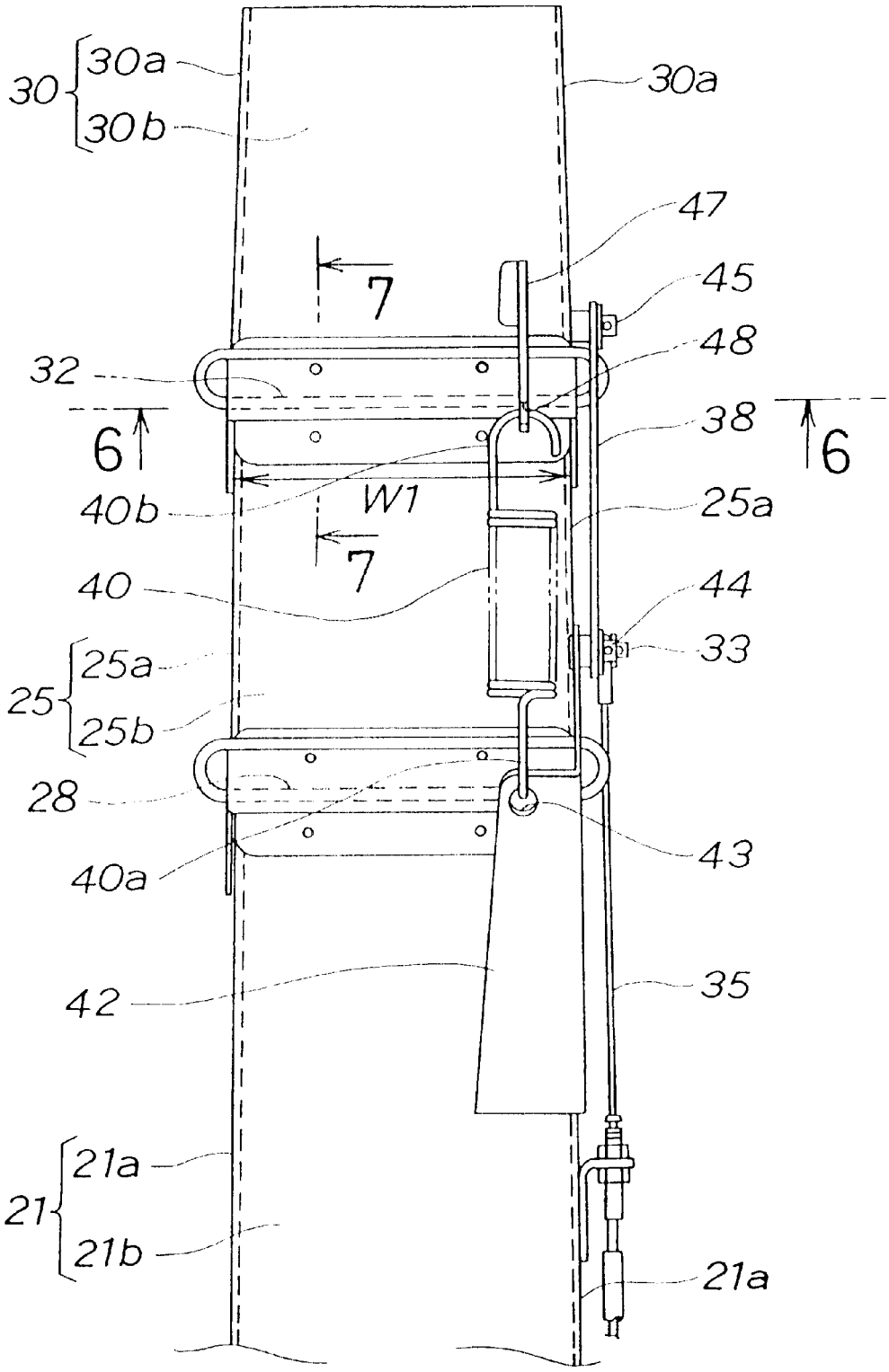
FIG. 3 is a rear elevation view of the chute structure of FIG. 1.

Referring to FIG. 2 and FIG. 3, the chute structure 20 includes a lower chute 21 rotationally mounted on the case 19, a middle chute (a first chute) 25 pivotally connected via a first hinge 28 to the lower chute 21, and an upper chute (a second chute) 30 pivotally connected via a second hinge 32 to the middle chute 25. The middle chute 25 includes a pair of sidewalls 25*a*, 25*a* (only one shown) and a center wall 25*b*. One edge of the sidewall 25*a* is connected through the center wall 25*b* to one edge of the other sidewall 25*a*. The middle chute 25 is generally U-shaped in cross-section. The upper chute 30 includes a pair of sidewalls 30*a*, 30*a* (only one shown) and a center wall 30*b*. The sidewall 30*a* has its one edge connected to one edge of the other sidewall 30*a* by means of the center wall 30*b*. The upper chute 30 has a generally U-shaped cross-section. The lower chute 21 includes a pair of sidewalls 21*a*, 21*a* and a center wall 21*b*. The sidewalls 21*a*, 21*a* are connected through the center wall 21*b* together at their edges. The lower chute 21 has a generally U-shaped cross-sectional configuration.

Either of the sidewalls 25*a*, 25*a* of the middle chute 25 has a pin 33 disposed externally thereof. The pin 33 is connected to a wire 35. A return spring 40 extends across the center wall 25*b*. The lower chute 21 is connected through the return spring 40 to the upper chute 30. When the wire 35 is pulled, the middle chute 25 and the upper chute 30 are pivoted together. When the wire 35 is returned from a pulled position to its original position, the return spring 40 is operated to bring the middle chute 25 and the upper chute 30 to their original positions. A mounting bracket 42 is generally L-shaped gin cross-section and extends from the center wall 21*b* to the sidewall 21*a*.

The bracket 42 extends upwardly from the lower chute 21 so that it has a supporting portion 42*a* positioned above the first hinge 28. A lower end 38*a* of a link 38 is rotationally connected via a stationary pin 44 to the supporting portion 42*a*. The link 38 has its upper end 38*b* rotationally connected through a movable pin 45 to an outer surface of the sidewall 30*a* of the upper chute 30. This arrangement connects the lower and upper chutes 21, 30 together. The bracket 42 has an engagement hole 43 formed therein. A peripheral edge defining the hole 43 engages a lower hook 40*a* of the return spring 40. The center wall 30*b* of the upper chute 30 has an engagement bracket 47 mounted thereon. The bracket 47 has an engagement hole 48 formed therein. A peripheral edge defining the engagement hole 48 engages an upper hook 40*b* of the return spring 40. The return spring 40 extends between the lower chute 21 and the upper chute 30.

The return spring 40 forces all of the middle chute 25, the upper chute 30 and the link 38 to an immovable state. This prevents the chute structure 20 from vibrating as the snow removing machine 10 is in operation.

The sidewalls 21*a*, 21*a* have first pins 22, 22 (only one shown) provided on upper ends thereof. The respective pins 22, 22 are movable within respective first guide apertures 26, 26 (only one shown) formed in the sidewalls 25*a*, 25*a*. Likewise, the sidewalls 25*a*, 25*a* of the middle chute 25 have second pins 27, 27 (only one shown) provided on upper ends thereof. The pins 27, 27 are movable within second guide apertures 31, 31 (only one shown), respectively, formed in the sidewalls 30*a*, 30*a*.

The return spring 40 is disposed in the proximity of one edge of the center wall 25*b*. The return spring 40 extends over the center wall 25*b*. The middle chute 25 is of width W1.

Figures 4A, 4B, 4C:
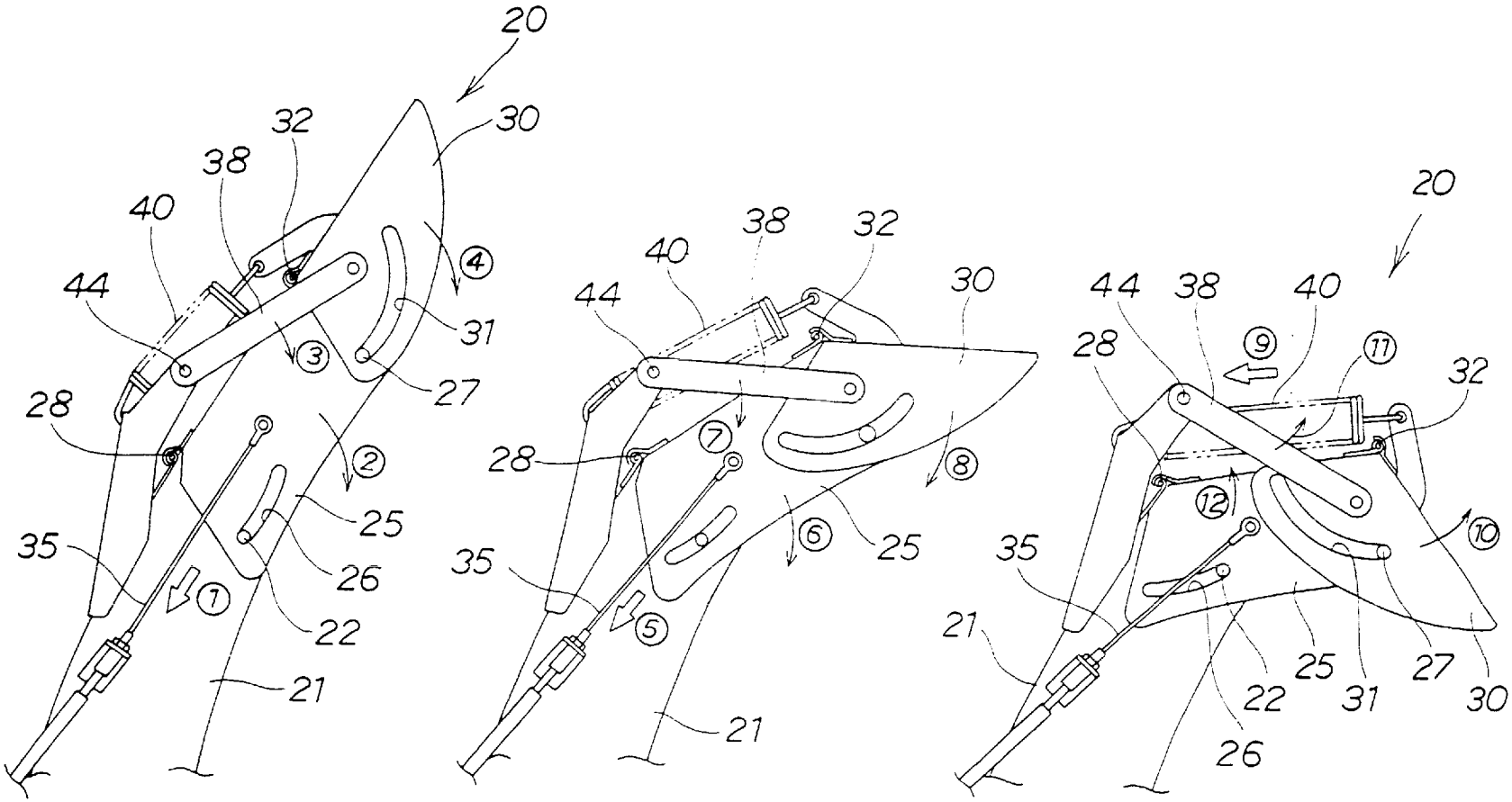
FIG. 4A illustrates the chute structure held in an unbent position.
FIG. 4B illustrates the chute structure in a bent position.
FIG. 4C illustrates the chute structure in a full bent position.

Turning to FIG. 4A, the return spring 40 urges the chute structure 20 to a straightened position. In this position, the first pin 22 is urged against a lower end of a peripheral edge defining the first guide aperture 26. The second pin 27 is urged against a lower end of a peripheral edge defining the second guide aperture 31. With this arrangement, the chute structure 20 is held in the straightened position.

When the wire 35 is pulled as indicated by an arrow ①, the middle chute 25 pivots on the first hinge 28, as shown by an arrow ②, whereupon the link 38 pivots downwardly on the stationary pin 44, as indicated by an arrow ③.

The downward pivotal movement of the link 38 causes the upper chute 30 to pivot on the second hinge 32, as indicated by an arow ④.

Reference is made to FIG. 4B. When the wire 35 is further pulled, as shown by an arrow ⑤, the middle chute 25 further pivots on the hinge 28, as indicated by an arrow ⑥. upon the further pivotal movement of the middle chute 25, the link 38 further pivots on the stationary pin 44, as shown by an arrow ⑦. This causes the upper chute 30 to further pivot on the second hinge 32, as indicated by an arrow ⑧. As a result, the chute structure 20 is brought to a full bent position, as shown in FIG. 4C.

With the chute structure 20 in the full bent position, the first pin 22 is urged against an upper end of the peripheral edge defining the first guide aperture 26 such that the middle chute 25 does not pivot anymore. At this time, the second pin 27 is urged against on an upper end of the peripheral edge defining the second guide aperture 31 to complete the pivotal movement of the upper chute 30.

When the wire is brought back to its original position, the return spring 40 is compressed or contracted, as indicated by an arrow ⑨, thereby causing the upper chute 30 to pivot upwardly on the second hinge 32 as shown by an arrow ⑩. This causes the link 38 to pivot upwardly on the stationary pin 44 as indicated by an arrow ⑪. The middle chute 25 then pivots upwardly on the first hinge 28 as shown by an arrow ⑫. Consequently, the chute structure 20 is brought back to the straightened position as shown in FIG. 4A.

Figure 5:
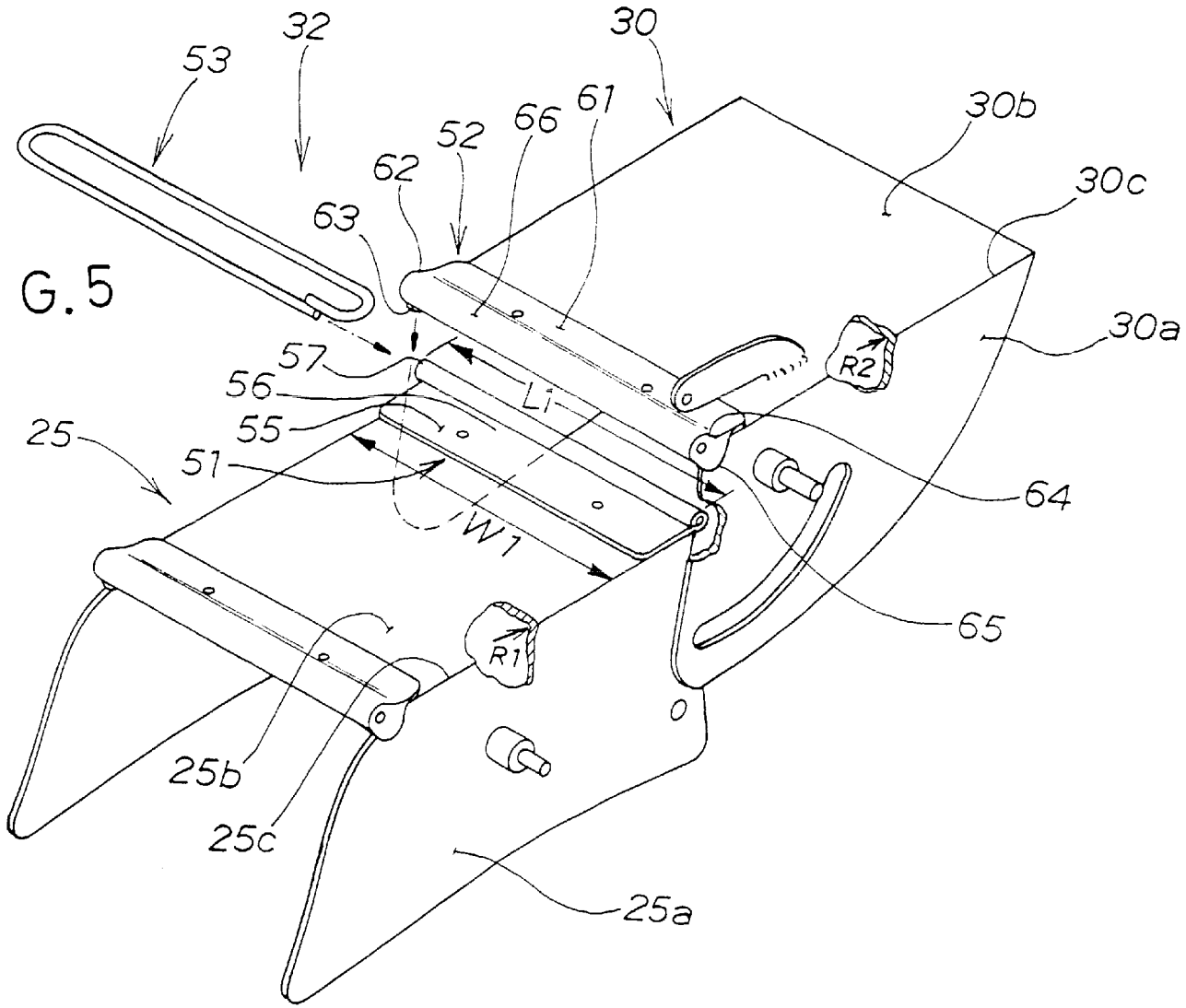
FIG. 5 is a view of the chute structure as partly disassembled into a middle chute, a second hinge, and an upper chute.

Reference is made to FIG. 5. It should be noted that the second hinge 32 alone will be described hereinafter because the first hinge 28 has the same construction as the second hinge 32. The second hinge 32 is disassembled to separate the middle chute 25 from the upper chute 30. A corner 25*c* at which the sidewall 25*a* meets the center wall 25*b* is curved to provide a given radius of curvature R1. A corner 30*c* where the sidewall 30*a* meets the center wall 30*b* is curved to provide a predetermined radius of curvature R2.

The radius of curvature R1 is set to be larger than the radius of curvature R2 (R1>R2).

The second hinge 32 includes a first hinge plate 51 mounted to the middle chute 25, a second hinge plate 52 mounted to the upper chute 30, and a connecting pin 53 for connecting together the first and second hinge plates 51, 52.

The first hinge plate 51 includes a body 55. The body 55 has a tubular portion 57 formed along an edge 56 thereof. The tubular portion 57 has a length L1 set to be substantially equal to the width W1 of the middle chute 25.

The second hinge plate 52 includes a body 61. The body 61 has a first plate 63 positioned at one end 62 thereof. Another end 64 of the body 61 has a second plate 65 positioned thereat. Each of the first and second plates 63, 65 has an opening formed therein. A cover portion 66 covers the tubular portion 57 and extends between the first plate 63 and the second plate 65. The cover portion 66 is integral with the first and second plates 63, 65.

Figure 6:
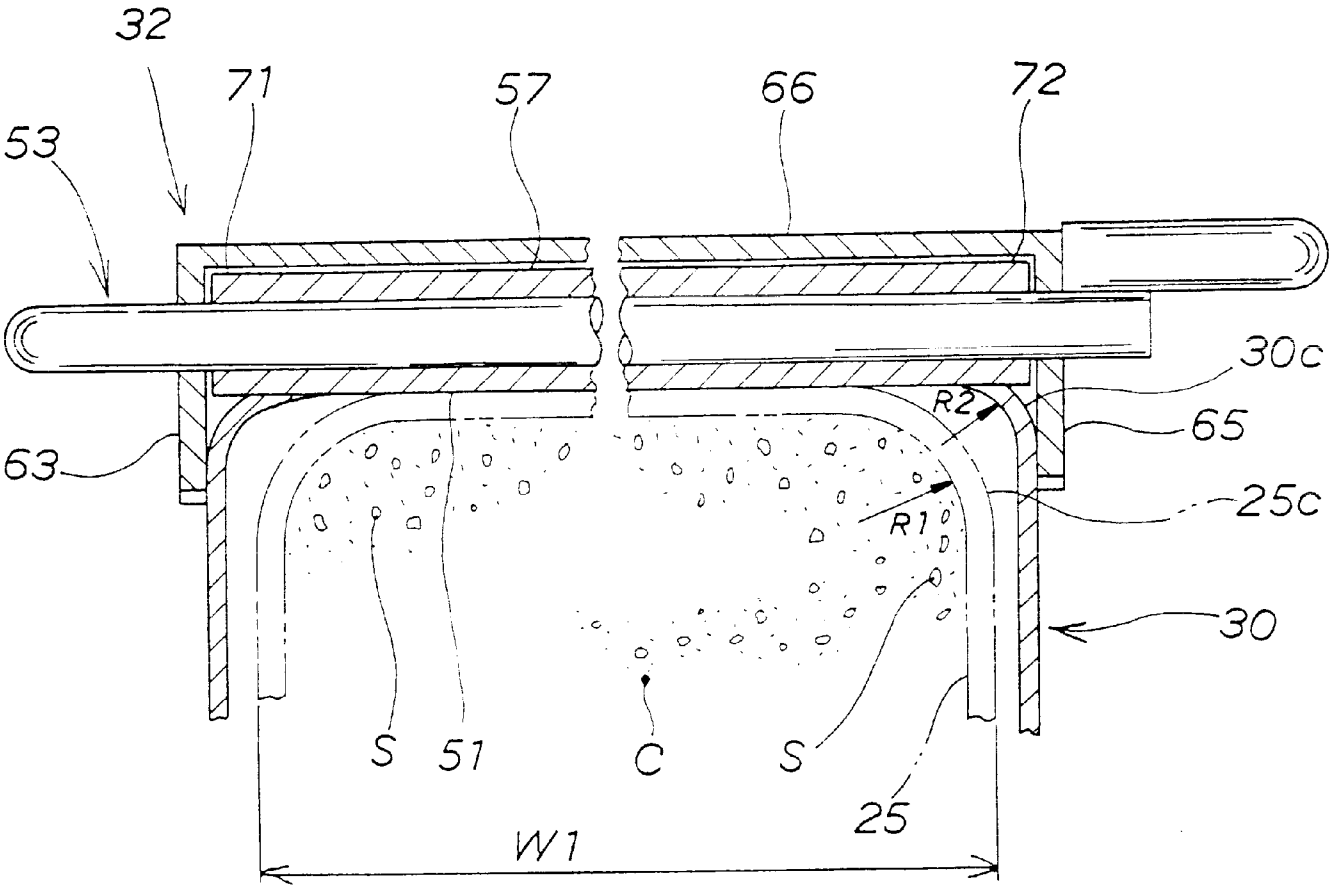
FIG. 6 is a cross-sectional view taken along line 6—6 of FIG. 3.

Turning to FIG. 6, the tubular portion 57 has an entrance (one end) 71 opposed to or aligned with the opening of the first plate 63. An exit (another end) 72 of the tubular portion 57 is opposite to or aligned with the opening of the second plate 65. The tubular portion 57 is covered with the cover portion 66.

The tubular portion 57 is a seamless single member. In other words, the tubular portion 57 has no gaps which, if the portion 57 were divided into plural members, would be formed between the adjacent members. Therefore, the tubular portion 57 does not allow snow S to be discharged out therethrough.

The corner 25*c* having the radius of curvature R1 is positioned closer to a center C than the corner 30*c* having the radius of curvature R2. The corner 25*c* of the middle chute 25 is positioned away from the first and second plates 63, 65. Consequently, snow S, which is directed through the middle chute 25 to the upper chute 30, is discharged from between the first and second plates 63, 65.

Figure 7:
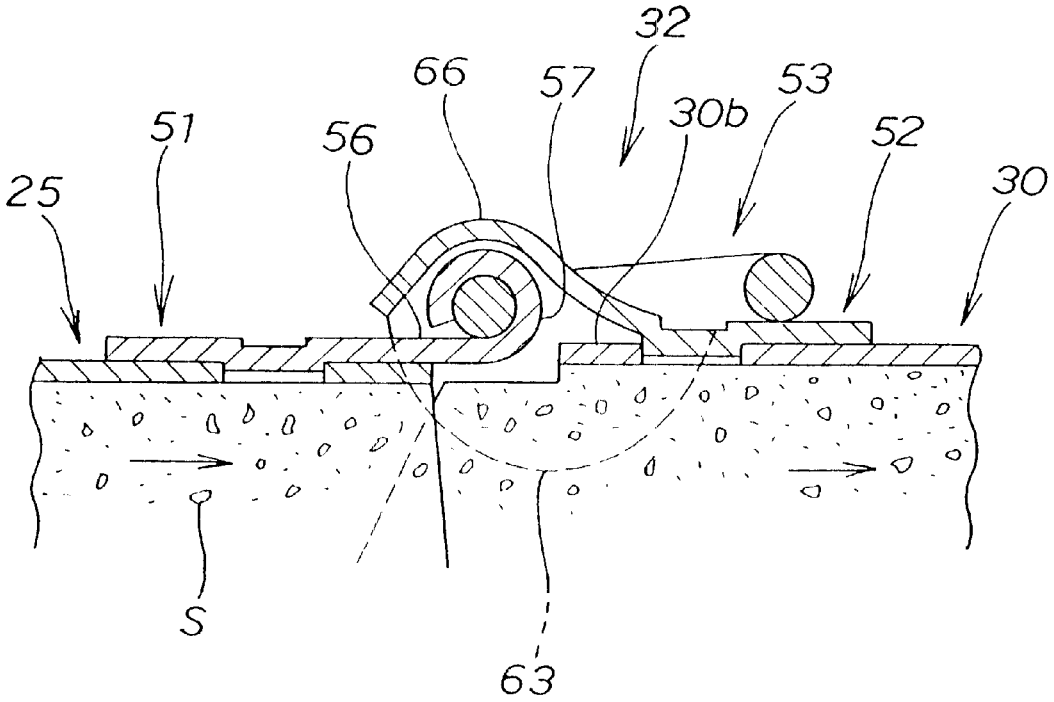
FIG. 7 is a cross-sectional view taken along line 7—7 of FIG. 3.

As shown in FIG. 7, the tubular portion 57 of the first hinge plate 51 is covered with the cover portion 66 of the second hinge plate 52. This arrangement has the advantage that the snow S is not likely to be discharged from between the tubular portion 57 and the center wall 30*b*.

It is to be understood that the second hinge 32 prevents the discharge of the snow S from between the tubular portion 57 and the center wall 30*b* even when the chute structure 20 pivots in the manner as stated in relation to FIG. 4B and FIG. 4C.

Discussion will be made as to how the chute structure of the present invention offers the advantage over the prior art chute.

Figure 8A:
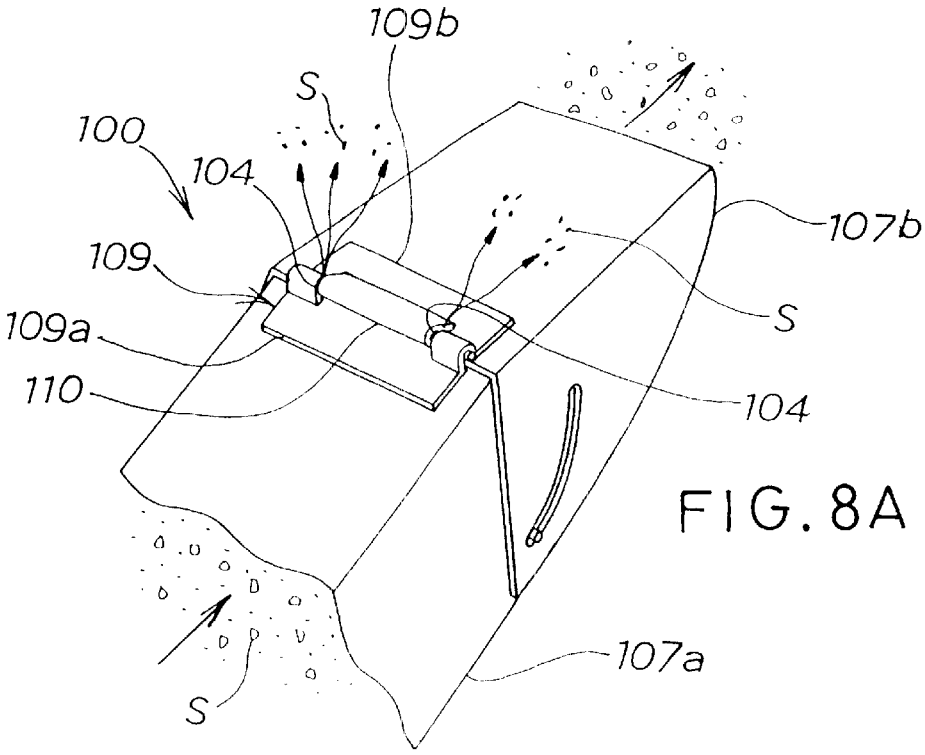
FIG. 8A shows a conventional chute.
Figure 13:
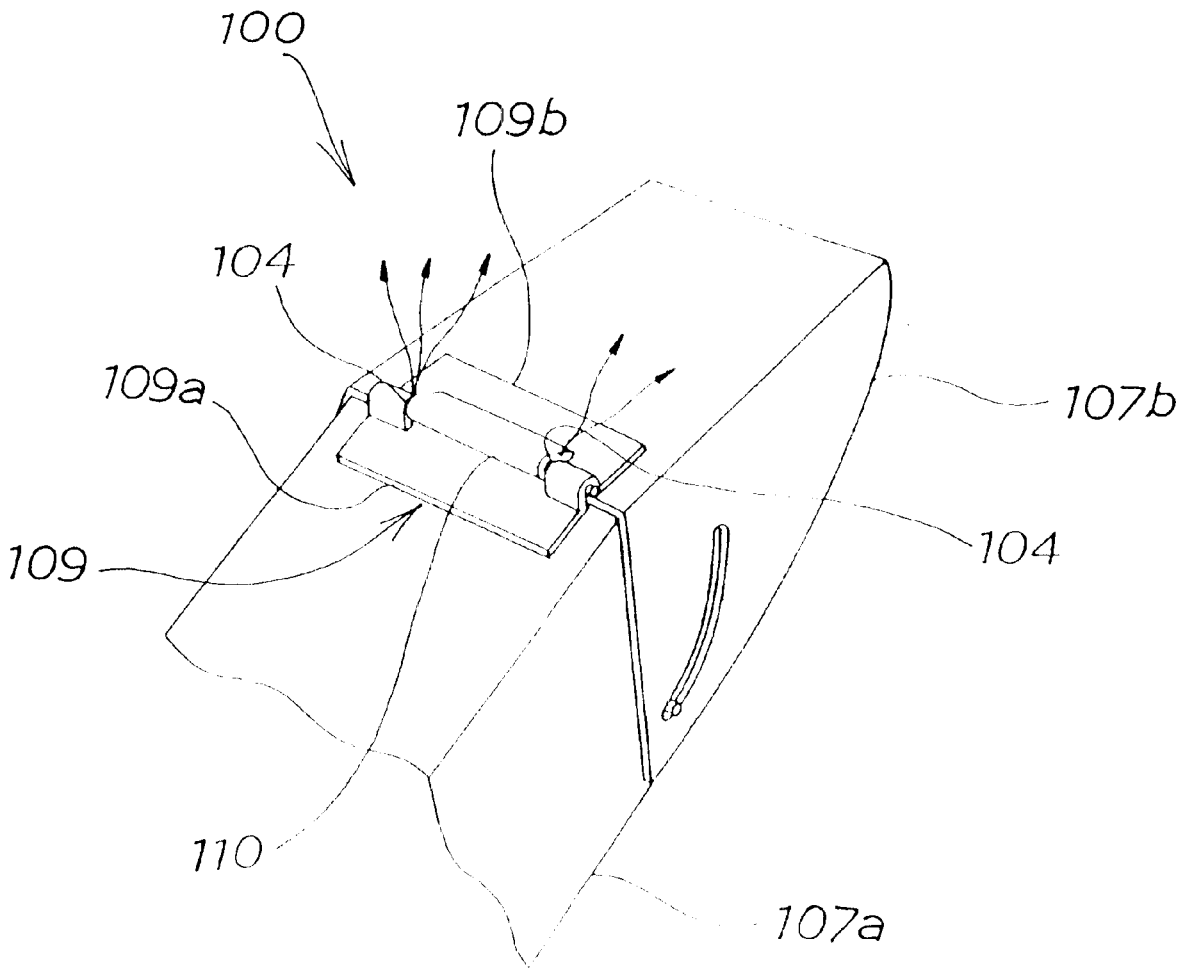
FIG. 13 (PRIOR ART)
FIG. 13 is a view illustrating the conventional chute shown in FIG. 8A.

With respect to FIG. 8A, there is shown the chute 100 as previously described in relation to FIG. 13. The chute 100 includes the chute body 107*a* and the chute guide 107*b* connected to the chute body 107*a* by means of the hinge member 109 comprised of the first and second hinge halves 109*a*, 109*b*. One problem with the chute 100 is that snow S could be undesirably discharged out through the clearances 104, 104 formed in the hinge member 109.

Figure 8B:
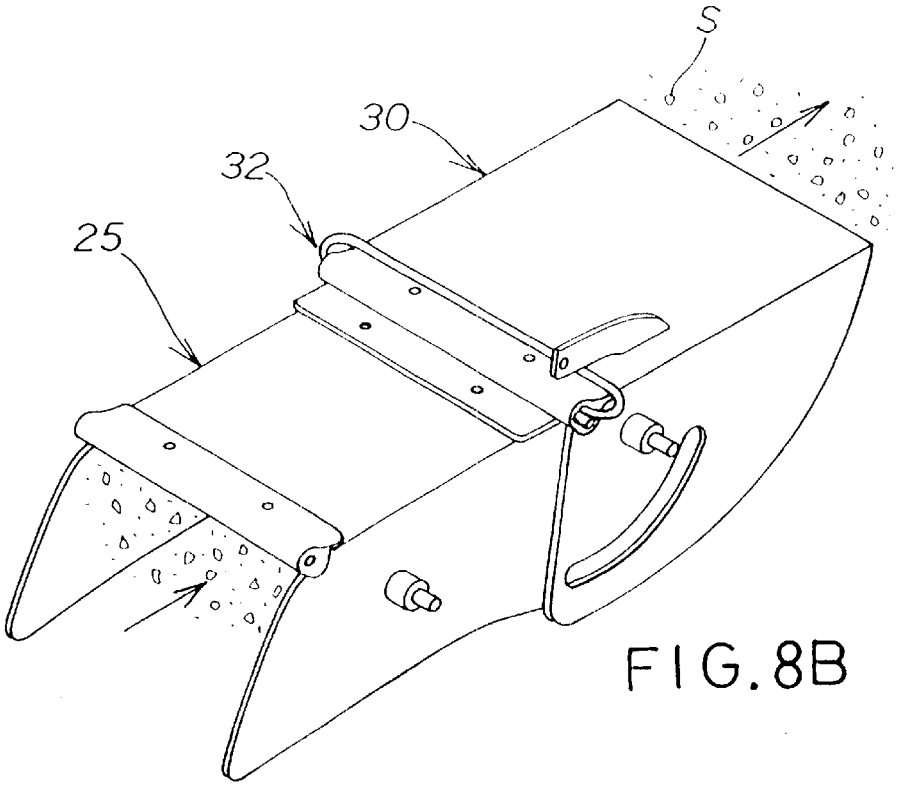
FIG. 8B shows the chute structure of the present invention.

As shown in FIG. 8B, the middle chute 25 of the chute structure 20 of the present invention is connected to the upper chute 30 via the second hinge 32. Use of the second hinge 32 prevents the undesirable discharge of the snow S as found in the prior art chute shown in FIG. 8A.

If desired, a seal may be provided between the tubular portion 57 and the cover portion 66.

The connecting pin 53 may have a variety of other configurations to serve the above-mentioned function.

Figure 9:
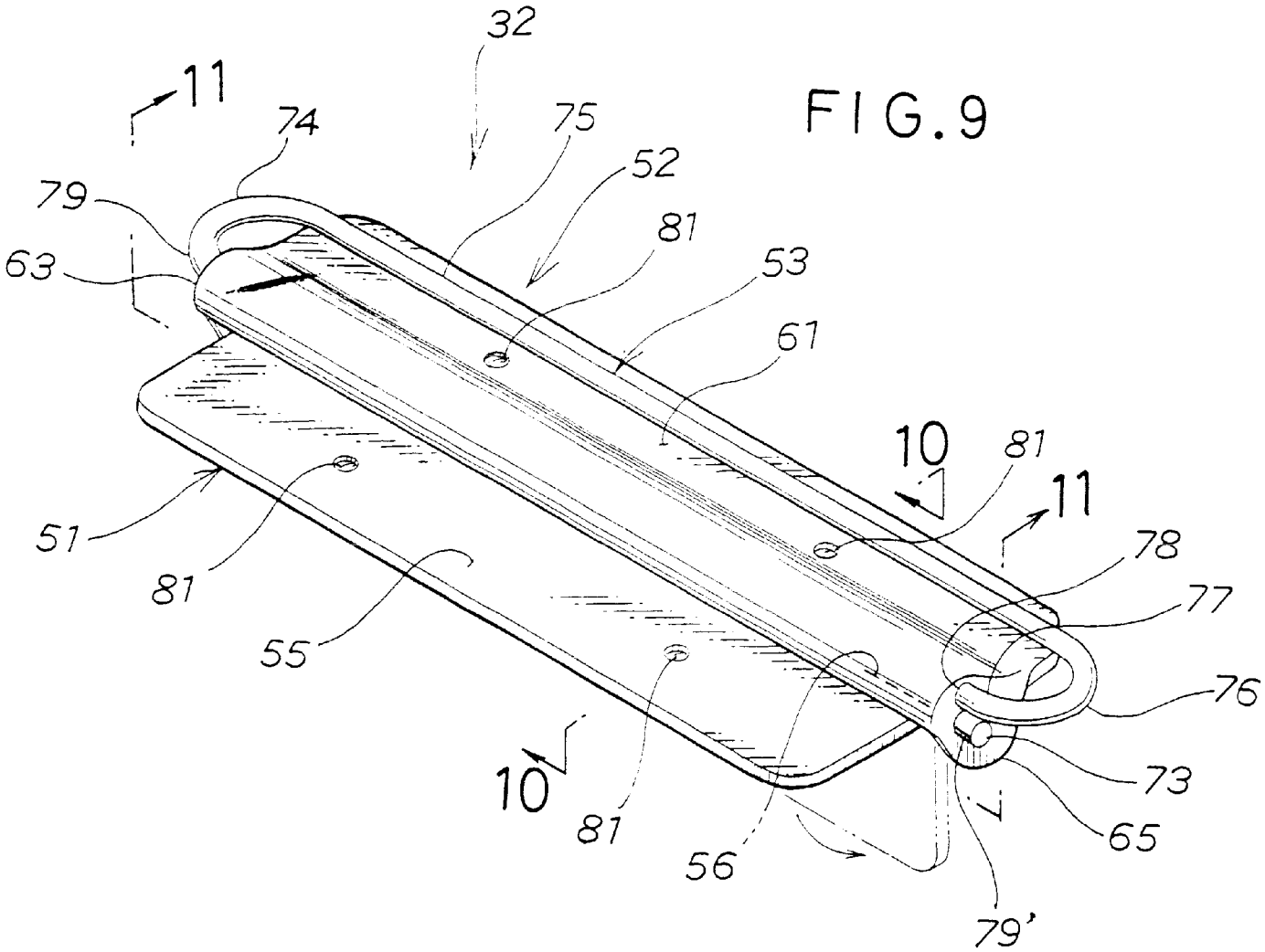
FIG. 9 is a view of the second hinge as assembled.
Figure 10:
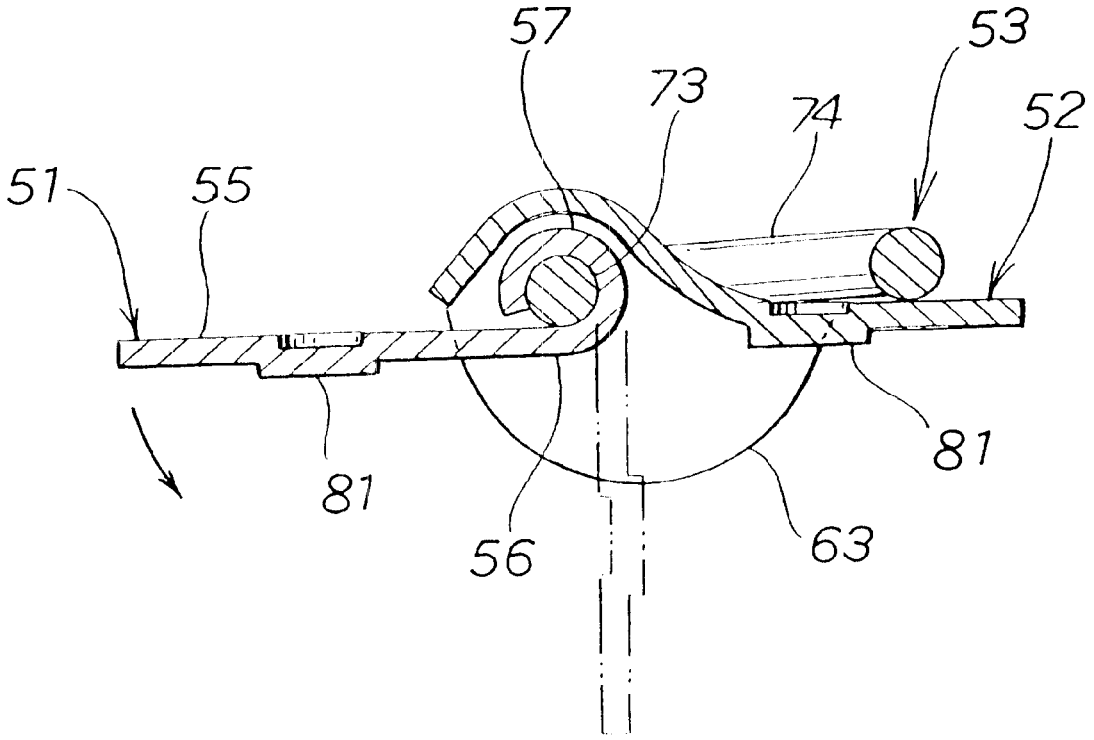
FIG. 10 is a cross-sectional view taken along line 10—10 of FIG. 9.
Figure 11:
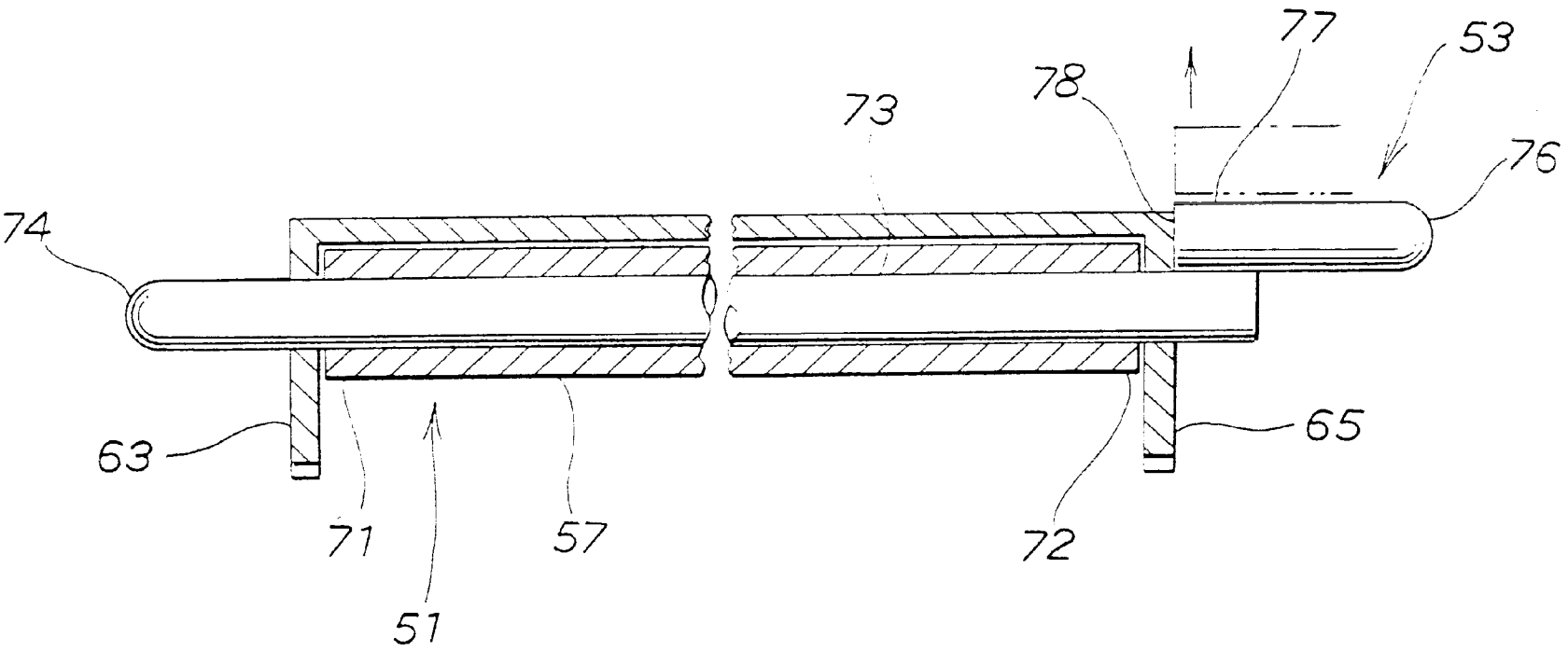
FIG. 11 is a cross-sectional view taken along line 11—11 of FIG. 9.

With reference to FIG. 9 through FIG. 11, at the edge 56 of the body 55 of the first hinge plate 51, there is formed the tubular portion 57. The first hinge plate 51 is pivotable, as shown by a phantom line of FIG. 9.

The body 61 of the second hinge plate 52 has the first and second plates 63, 65 positioned at opposite ends thereof. The second hinge plate 52 is pivotable as is the first hinge plate 51. The bodies 55, 61 have projecting portions 81, 81, respectively. The projecting portions 81, 81 protrude downwardly from the undersides of the bodies 55, 61. With the projecting portion 81, 81 fitted into apertures (not shown) formed in the middle and upper chutes 25, 30, the bodies 55, 61 are welded to the middle and upper chutes 25, 30, respectively.

The connecting pin 53 is substantially rectangular. The connecting pin 53 includes a body 73, a first U-shaped portion 74, a return portion 75, and a second U-shaped portion 76 (see FIG. 12). The first U-shaped portion 74 is continuous with one end 79 of the body 73. The return portion 75 is continuous with the first U-shaped portion 74 and has substantially the same length as the body 73. The return portion 75 extends in substantially parallel to the body 73. The return portion 75 is continuous with the second U-shaped portion 76. A distal end 77 of the second U-shaped portion 76 is laid on another end 79' of the body 73. Reference numeral 78 denotes a surface of the distal end 77.

The tubular portion 57 is formed at the edge 56 of the first hinge plate 51. The entrance 71 of the tubular portion 57 of the first hinge plate 51 is opposed to or aligned with the opening of the first plate 63. The exit 72 of the tubular portion 57 is opposite to or aligned with the opening of the second plate 65. The body 73 extends through the opening of the first plate 63, the tubular portion 57, and the opening of the second plate 65. The surface 78 of the second U-shaped portion 76 rests or abutted on the second plate 65, such that the body 73 is not inadvertently pulled through the tubular portion 57 out of the opening of the first plate 63.

When the distal end 77 is elastically moved in a direction (as indicated by an arrow of FIG. 11) away from the body 73, as shown by a phantom line, the surface 78 is brought out of contact with the second plate 65. With the surface 78 kept off the second plate 65, the body 73 can be pulled through the tubular portion 57 out of the opening of the first plate 63.

Description will be made as to how the second hinge 32 is assembled.

Figure 12:
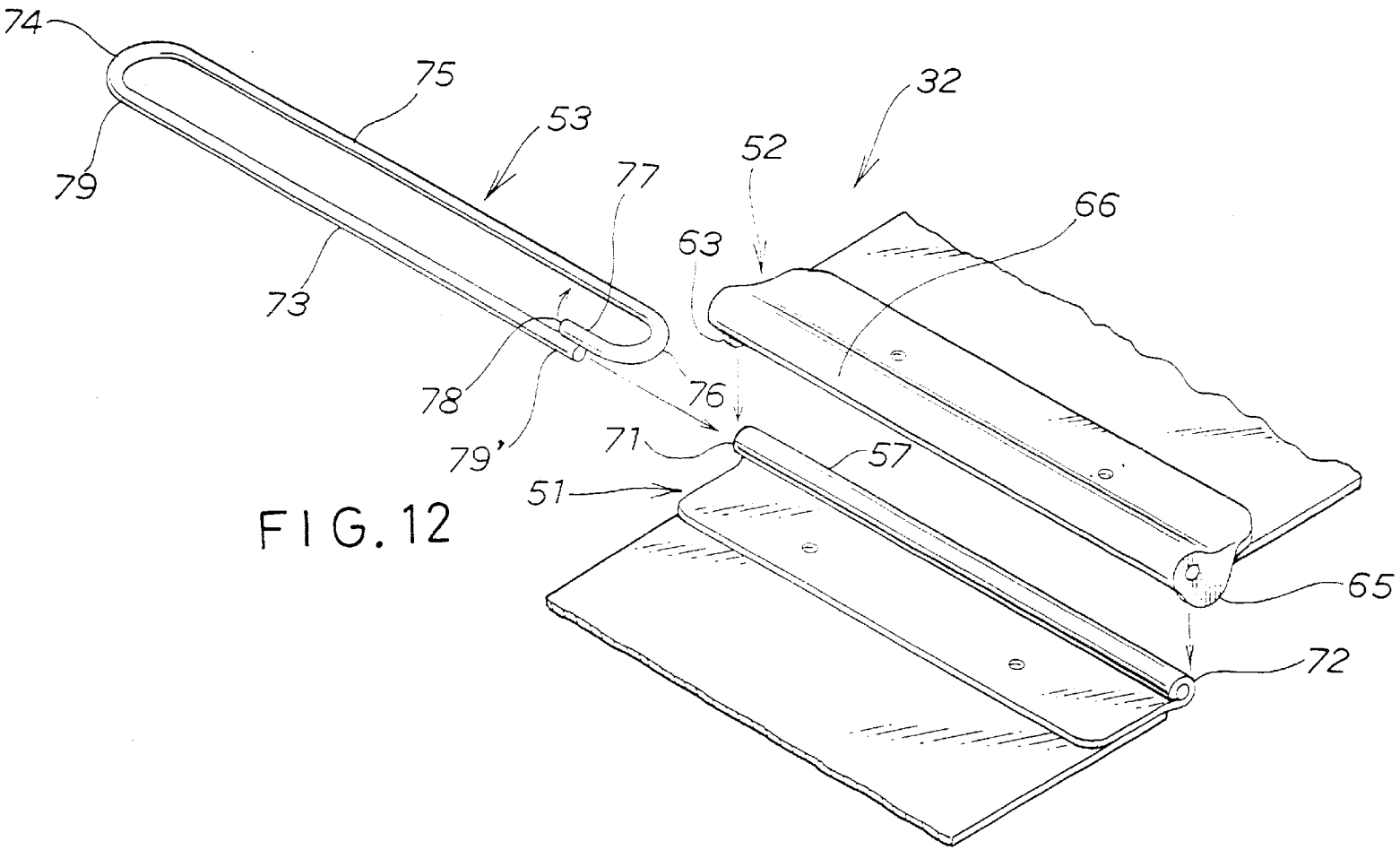
FIG. 12 is a view of the second hinge as disassembled.

Turning to FIG. 12, the first and second plates 63, 65 are moved into alignment with the entrance 71 and the exit 72, respectively, as shown by arrows. Then, the second U-shaped portion 76 is elastically pivoted, as shown by an arrow, to thereby move the distal end 77 away from the body 73. With the distal end 77 kept off the body 73, the body 73 is inserted through the opening of the first plate 63 into the tubular portion 57, as shown by an arrow, until the another end 79' of the body 73 projects from the opening of the second plate 65.

Since the distal end 77 is elastically moved away from the body 73 before the insertion of the body 73, the body 73 can be inserted through the opening of the first plate 63 into the tubular portion 57 with no interference established between the distal end 77 and the cover portion 66 of the second hinge plate 52.

After the insertion of the body 73 through the tubular portion 57, the distal end 77 is automatically moved back onto the body 73 to bring the surface 78 of the distal end 77 into abutment on the second plate 65. With this arrangement, the connecting pin 53 is prevented from being pulled through the tubular portion 57 out of the opening of the first plate 63.

The second hinge 32 can be disassembled by reversing the sequence of assembly as stated above. More specifically, the distal end 77 is elastically moved such that the surface 78 becomes out of abutment on the second plate 65. With the surface 78 kept away from the second plate 65, the body 73 is pulled through the tubular portion 57 out of the opening of the first plate 63. It is therefore becomes possible to easily disassemble the second hinge 32.

By thus disassembling the second hinge 32, the middle chute 25 and the upper chute 30 can be separated from each other for ease of repair or replacement.

When the second hinge 32 is assembled, the distal end 77 is automatically moved back onto the body 73 to thereby lock the connecting pin 53. In other words, assembly of the second hinge 32 does not require using screws or bending the connecting pin 53.

The insertion of the connecting pin 53 can be achieved without requiring any tools. As a result, the second hinge 32 can be readily assembled with increased efficiency.

In the illustrated embodiment, the first and second hinge plates 51, 52 have the projecting portions 81, 81 for attachment to the middle and upper chutes 25, 30, respectively, they may be altered to have formed therein openings for the attachment.

The first and second hinge plates 51, 52 may be mounted to the middle and upper chutes 25, 30 in a variety of other ways, for example, by use of screws.

Obviously, various minor changes and modifications of the present invention are possible in the light of the above teaching. It is therefore to be understood that within the scope of the appended claims, the present invention may be practiced otherwise than as specifically described.

What is claimed is:

1. A chute structure for a snow removing machine, comprising:

a first chute; and a second chute pivotally connected via a hinge to said first chute;

said hinge including:

a first hinge plate mounted to said first chute and having a tubular portion of length substantially equal to a width of said first chute;

a second hinge plate mounted to said second chute, said second hinge plate including a first plate being positioned outside one end of said tubular portion and having formed therein an opening aligned with the one end of said tubular portion, a second plate being positioned outside another end of said tubular portion and having formed therein an opening aligned with the another end of said tubular portion, and a cover portion extending between said first plate and said second plate and covering said tubular portion; and a connecting pin extending through the opening of said first plate, said tubular portion, and the opening of said second plate to connect said first hinge plate and said second hinge plate together.

2. A chute structure for a snow removing machine, according to claim 1, wherein said connecting pin is substantially rectangular, and includes:

a body extending through the opening of said first plate, said tubular portion, and the opening of said second plate;

a first U-shaped portion continuous with one end of said body;

a return portion continuous with said first U-shaped portion and having substantially the same length as said body; and a second U-shaped portion continuous with said return portion and having a distal end laid on said body, said distal end having a surface abutted on said second plate.

* * * * *